US011225697B2

(12) United States Patent
Watson et al.

(10) Patent No.: US 11,225,697 B2
(45) Date of Patent: Jan. 18, 2022

(54) HOT ROLLED LIGHT-GAUGE MARTENSITIC STEEL SHEET AND METHOD FOR MAKING THE SAME

(71) Applicant: NUCOR CORPORATION, Charlotte, NC (US)

(72) Inventors: James W. Watson, Brownsburg, IN (US); Paul Kelly, Charlotte, NC (US); David C. Van Aken, Charlotte, NC (US); Christopher Ronald Killmore, North Sydney (AU)

(73) Assignee: NUCOR CORPORATION, Charlotte, NC (US)

( * ) Notice: Subject to any disclaimer, the term of this patent is extended or adjusted under 35 U.S.C. 154(b) by 1644 days.

(21) Appl. No.: 14/974,628

(22) Filed: Dec. 18, 2015

(65) Prior Publication Data

US 2016/0177411 A1 Jun. 23, 2016

Related U.S. Application Data

(60) Provisional application No. 62/115,343, filed on Feb. 12, 2015, provisional application No. 62/094,572, filed on Dec. 19, 2014.

(51) Int. Cl.
*C21D 8/02* (2006.01)
*B22D 11/00* (2006.01)
(Continued)

(52) U.S. Cl.
CPC ..... *C21D 8/0205* (2013.01); *B22D 11/001* (2013.01); *B22D 11/0622* (2013.01);
(Continued)

(58) Field of Classification Search
CPC ..... C21D 8/0205; C21D 6/002; C21D 6/005; C21D 6/008; C21D 8/0226; C21D 8/0263;
(Continued)

(56) References Cited

U.S. PATENT DOCUMENTS 2,853,410 A 9/1958 Lula
3,053,703 A 9/1962 Breyer
(Continued)

FOREIGN PATENT DOCUMENTS

CA 228424 A 1/1923
CN 100439543 C 12/2008
(Continued)

OTHER PUBLICATIONS

Machine Translation of KR-20130046967-A (Year: 2013).*
(Continued)

*Primary Examiner* — Paul A Wartalowicz
*Assistant Examiner* — Ryan L Heckman
(74) *Attorney, Agent, or Firm* — Hahn Loeser & Parks LLP

(57) ABSTRACT

A hot rolled light-gauge martensitic steel sheet made by the steps comprising: (a) preparing a molten steel melt comprising: (i) by weight, between 0.20% and 0.35% carbon, less than 1.0% chromium, between 0.7% and 2.0% manganese, between 0.10% and 0.50% silicon, between 0.1% and 1.0% copper, less than 0.05% niobium, less than 0.5% molybdenum, and silicon killed containing less than 0.01% aluminum, and (ii) the remainder iron and impurities resulting from melting; (b) solidifying at a heat flux greater than 10.0 $MW/m^2$ and cooling the molten melt into a steel sheet less than 2.0 mm in thickness in a non-oxidizing atmosphere to below 1080° C. and above $Ar_3$ temperature at a cooling rate greater than 15° C./s; and (c) hot rolling the steel sheet to between 15% and 50% reduction and rapidly cooling.

19 Claims, 3 Drawing Sheets

(51) Int. Cl.

| | |
|---|---|
| ***B22D 11/06*** | (2006.01) |
| ***C21D 6/00*** | (2006.01) |
| ***C22C 38/02*** | (2006.01) |
| ***C22C 38/04*** | (2006.01) |
| ***C22C 38/06*** | (2006.01) |
| ***C22C 38/20*** | (2006.01) |
| ***C22C 38/22*** | (2006.01) |
| ***C22C 38/26*** | (2006.01) |
| ***C22C 38/38*** | (2006.01) |

(52) U.S. Cl.
CPC ..... *C21D 6/002* (2013.01); *C21D 6/005* (2013.01); *C21D 6/008* (2013.01); *C21D 8/0226* (2013.01); *C21D 8/0263* (2013.01); *C22C 38/02* (2013.01); *C22C 38/04* (2013.01); *C22C 38/06* (2013.01); *C22C 38/20* (2013.01); *C22C 38/22* (2013.01); *C22C 38/26* (2013.01); *C22C 38/38* (2013.01)

(58) Field of Classification Search
CPC ... B22D 11/001; B22D 11/0622; C22C 38/02; C22C 38/04; C22C 38/06; C22C 38/20; C22C 38/22; C22C 38/26; C22C 38/38
See application file for complete search history.

(56) References Cited

U.S. PATENT DOCUMENTS

| | | | | |
|---|---|---|---|---|
| 3,258,372 | A | 6/1966 | Miller et al. | |
| 3,378,360 | A | 4/1968 | McFarland | |
| 4,594,115 | A | 6/1986 | Lacoude et al. | |
| 5,470,529 | A | 11/1995 | Nomura et al. | |
| 5,817,196 | A | 10/1998 | Teracher et al. | |
| 6,187,117 | B1 | 2/2001 | Shen et al. | |
| 6,273,973 | B1 | 8/2001 | Parayil et al. | |
| 6,284,063 | B1 | 9/2001 | Espenhahn et al. | |
| 6,328,826 | B1 | 12/2001 | Iung et al. | |
| 6,364,968 | B1 * | 4/2002 | Yasuhara ..... | C21D 1/20 148/320 |
| 6,797,411 | B2 | 9/2004 | Sodani et al. | |
| 6,852,180 | B1 | 2/2005 | Faral et al. | |
| 7,093,342 | B2 | 8/2006 | Ziegelaar et al. | |
| 2003/0145911 | A1 | 8/2003 | Hoffmann et al. | |
| 2004/0112484 | A1 * | 6/2004 | Saito ..... | C21D 8/02 148/638 |
| 2005/0092396 | A1 | 5/2005 | Takemura et al. | |
| 2006/0237162 | A1 | 10/2006 | Schlichting et al. | |
| 2007/0144633 | A1 | 6/2007 | Kizu et al. | |
| 2007/0190353 | A1 | 8/2007 | Taniguchi et al. | |
| 2008/0032150 | A1 | 2/2008 | Blejde et al. | |
| 2009/0252641 | A1 | 10/2009 | Hoshi et al. | |
| 2009/0277546 | A1 | 11/2009 | Hammer et al. | |
| 2010/0065161 | A1 | 3/2010 | Hammer et al. | |
| 2010/0065162 | A1 | 3/2010 | Hammer et al. | |
| 2010/0096047 | A1 | 4/2010 | Hammer et al. | |
| 2013/0136950 | A1 | 5/2013 | Sun | |
| 2013/0202914 | A1 | 8/2013 | Edelman et al. | |
| 2014/0261905 | A1 * | 9/2014 | Blejde ..... | B22D 11/0622 148/541 |
| 2014/0366602 | A1 | 12/2014 | Fang et al. | |
| 2017/0044639 | A1 * | 2/2017 | Kitsuya ..... | C21D 8/02 |

FOREIGN PATENT DOCUMENTS

| | | | |
|---|---|---|---|
| EP | 0937512 | A1 | 8/1999 |
| EP | 0969112 | A1 | 1/2000 |
| EP | 1396550 | A1 | 3/2004 |
| EP | 1072689 | A1 | 4/2004 |
| EP | 1319725 | A2 | 10/2004 |
| EP | 1493832 | A1 | 1/2005 |
| EP | 1375694 | B1 | 4/2005 |
| EP | 1398390 | A1 | 1/2006 |
| JP | 61189845 | A | 8/1986 |
| JP | 10130776 | A | 5/1998 |
| JP | 2000176508 | A | 6/2000 |
| JP | 2004323951 | A | 11/2004 |
| KR | 20130046967 | A * | 5/2013 |
| KR | 20130046967 | A | 5/2013 |
| WO | 9802589 | A1 | 1/1998 |
| WO | 9840522 | A1 | 9/1998 |
| WO | 0055381 | A1 | 9/2000 |
| WO | 0121844 | A1 | 3/2001 |
| WO | 0226424 | A1 | 4/2002 |
| WO | 0248410 | A1 | 6/2002 |
| WO | 2005087965 | A1 | 9/2005 |
| WO | 2005095664 | A1 | 10/2005 |
| WO | 2013082188 | A1 | 6/2013 |

OTHER PUBLICATIONS

Bramfitt, B L, and Arlan O. Benscoter. Metallographer's Guide: Practice and Procedures for Irons and Steels. Materials Park, OH: ASM International, 2001 (Year: 2001).*

J.L. Dossett & H.E. Boyer, Practical Heat Treating, Chapter 2: Fundamentals of the Heat Treating of Steel, 9-25 (ASM International, 2nd ed. 2006) available at https://www.asminternational.org/documents/10192/1849770/acf180b.pdf.

* cited by examiner

HOT ROLLED LIGHT-GAUGE MARTENSITIC STEEL SHEET AND METHOD FOR MAKING THE SAME

This patent application claims priority to U.S. Provisional Application No. 62/094,572, filed on Dec. 19, 2014; and to U.S. Provisional Application No. 62/115,343, filed Feb. 12, 2015.

BACKGROUND AND SUMMARY

This invention relates to the making of hot rolled light-gauge martensitic steel sheet and the method for making the same by a twin roll caster.

In a twin roll caster, molten metal is introduced between a pair of counter-rotated, internally cooled casting rolls so that metal shells solidify on the moving roll surfaces, and are brought together at the nip between them to produce a solidified strip product, delivered downwardly from the nip between the casting rolls. The term "nip" is used herein to refer to the general region at which the casting rolls are closest together. The molten metal is poured from a ladle through a metal delivery system comprised of a tundish and a core nozzle located above the nip to form a casting pool of molten metal, supported on the casting surfaces of the rolls above the nip and extending along the length of the nip. This casting pool is usually confined between refractory side plates or dams held in sliding engagement with the end surfaces of the rolls so as to dam the two ends of the casting pool against outflow.

Martensite is formed in carbon steels by the rapid cooling, or quenching, of austenite. Austenite has a particular crystalline structure known as face-centered cubic (FCC). If allowed to cool naturally, austenite turns into ferrite and cementite. However, when the austenite is rapidly cooled, or quenched, the face-centered cubic austenite transforms to a highly strained body-centered tetragonal (BCT) form of ferrite that is supersaturated with carbon. The shear deformations that result, produce large numbers of dislocations, which is a primary strengthening mechanism of steels. The martensitic reaction begins during cooling when the austenite reaches the martensite start temperature and the parent austenite becomes thermodynamically unstable. As the sample is quenched, an increasingly large percentage of the austenite transforms to martensite until the lower transformation temperature is reached, at which time the transformation is completed.

Martensitic steels are increasingly being used in applications that require high strength, for example, in the automotive industry. Martensitic steel provides the strength necessary by the automotive industry while decreasing energy consumption and improving fuel economy.

Presently disclosed is a hot rolled light-gauge martensitic steel sheet made by the steps comprising: (a) preparing a molten steel melt comprising: (i) by weight, between 0.20% and 0.35% carbon, less than 1.0% chromium, between 0.7% and 2.0% manganese, between 0.10% and 0.50% silicon, between 0.1% and 1.0% copper, less than 0.05% niobium, less than 0.5% molybdenum, and silicon killed containing less than 0.01% aluminum, and (ii) the remainder iron and impurities resulting from melting; (b) solidifying at a heat flux greater than 10.0 $MW/m^2$ into a steel sheet less than 2.0 mm in thickness and cooling the sheet in a non-oxidizing atmosphere to below 1080° C. and above $Ar_3$ temperature at a cooling rate greater than 15° C./s; and (c) hot rolling the steel sheet to between 15% and 50% reduction and rapidly cooling to form a steel sheet with a microstructure having by volume at least 75% martensite, a yield strength of between 700 and 1300 MPa, a tensile strength of between 1000 and 1800 MPa and an elongation of between 1% and 10%. Here and elsewhere in this disclosure elongation means total elongation. And by "rapidly cooling" is meant to cool at a rate of more than 100° C./s to between 100 and 20° C.

The present steel sheet cannot be made with carbon levels below 0.20% because it is inoperative with peritectic cracking of the steel sheet as explained below.

Further, the steel sheet may be tempered at a temperature between 150° C. and 250° C. for between 2 and 6 hours. The martensitic steel sheet may further comprise by weight greater than 0.005% niobium or greater than 0.01% or 0.02% niobium. The martensitic steel sheet may further comprise by weight greater than 0.05% molybdenum or greater than 0.1% or 0.2% molybdenum.

The molten melt may be solidified at a heat flux greater than 10.0 $MW/m^2$ into a steel sheet less than 2.0 mm in thickness, and the sheet may be cooled in a non-oxidizing atmosphere to below 1080° C. and above $Ar_3$ temperature at a cooling rate greater than 15° C./s. A non-oxidizing atmosphere is an atmosphere typically of an inert gas such as nitrogen or argon, or a mixture thereof, which contains less than about 5% oxygen by weight.

In some embodiments, the martensite in the steel sheet may come from an austenite grain size of greater than 100 μm. In other embodiments, the martensite in the steel sheet may come from an austenite grain size of greater than 150 μm.

The steel sheet may be hot rolled to between 15% and 35% reduction and rapidly cooled to form a steel sheet with a microstructure having at least 75% martensite, a yield strength of between 700 and 1300 MPa, a tensile strength of between 1000 and 1800 MPa and an elongation of between 1% and 10%. In other embodiments, the steel sheet may be hot rolled to between 15% and 50% reduction and rapidly cooled to form a steel sheet with a microstructure having at least 75% martensite plus bainite, a yield strength of between 700 and 1300 MPa, a tensile strength of between 1000 and 1800 MPa and an elongation of between 1% and 10%. Further, the steel sheet may be hot rolled to between 15% and 35% reduction and rapidly cooled to form a steel sheet with a microstructure having at least 75% martensite plus bainite, a yield strength of between 700 and 1300 MPa, a tensile strength of between 1000 and 1800 MPa and an elongation of between 1% and 10%.

The molten steel used to produce the hot rolled light gauge martensitic steel sheet is silicon killed (i.e., silicon deoxidized). The martensitic steel sheet may further comprise by weight less than 0.008% aluminum or less than 0.006% aluminum. The molten melt may have a free oxygen content between 5 to 70 ppm. The steel sheet may have a total oxygen content greater than 50 ppm. The inclusions include $MnOSiO_2$ typically with 50% less than 5 μm in size and have the potential to enhance microstructure evolution and, thus, the strip mechanical properties.

Also disclosed is a method of making hot rolled light-gauge martensitic steel sheet comprising the steps of: (a) preparing a molten steel melt comprising: (i) by weight, between 0.20% and 0.35% carbon, less than 1.0% chromium, between 0.7% and 2.0% manganese, between 0.10% and 0.50% silicon, between 0.1% and 1.0% copper, less than 0.05% niobium, less than 0.5% molybdenum, and silicon killed containing less than 0.01% aluminum, and (ii) the remainder iron and impurities resulting from melting; (b) forming the molten melt into a casting pool supported on casting surfaces of a pair of cooled casting rolls having a nip there between; (c) counter rotating the casting rolls and solidifying at a heat flux greater than 10.0 $MW/m^2$ producing a steel sheet less than 2.0 mm in thickness and cooling the sheet in a non-oxidizing atmosphere to below 1080° C. and above $Ar_3$ temperature at a cooling rate greater than 15° C./s and (d) hot rolling the steel sheet to between 15% and 50% reduction and rapidly cooling to form a steel sheet with a microstructure having at least 75% martensite, a yield strength of between 700 and 1300 MPa, a tensile strength of between 1000 and 1800 MPa and an elongation of between 1% and 10%. The steel sheet composition cannot be made with carbon levels below 0.20% because it is inoperative with peritectic cracking of the steel sheet.

Further, the method of making hot rolled light-gauge martensite steel sheet may comprise the step of tempering the steel sheet at a temperature between 150° C. and 250° C. for between 2 and 6 hours.

The martensitic steel sheet may further comprise by weight greater than 0.005% niobium or greater than 0.01% or 0.02% niobium. The martensitic steel sheet may further comprise by weight greater than 0.05% molybdenum or greater than 0.1% or 0.2% molybdenum. The martensitic steel sheet may be silicon killed containing by weight less than 0.008% aluminum or less than 0.006% aluminum.

The molten melt may have a free oxygen content between 5 to 70 ppm. The steel sheet may have a total oxygen content greater than 50 ppm. The molten melt may be solidified at a heat flux greater than 10.0 $MW/m^2$ into a steel sheet less than 2.0 mm in thickness, and cooled in a non-oxidizing atmosphere to below 1080° C. and above $Ar_3$ temperature at a cooling rate between greater than 15° C./s.

In some embodiments, the martensite in the steel sheet may come from an austenite grain size of greater than 100 μm. In other embodiments, the martensite in the steel sheet may come from an austenite grain size of greater than 150 μm.

The method of making hot rolled light-gauge martensitic steel sheet may further comprise hot rolling the steel sheet to between 15% and 35% reduction and rapidly cooling to form a steel sheet with a microstructure having at least 75% by volume martensite, a yield strength of between 700 and 1300 MPa, a tensile strength of between 1000 and 1800 MPa and an elongation of between 1% and 10%. In some embodiments, the method of making hot rolled light-gauge martensitic steel sheet may further comprise hot rolling the steel sheet to between 15% and 50% reduction and rapidly cooling to form a steel sheet with a microstructure having at least 75% by volume martensite plus bainite, a yield strength of between 700 and 1300 MPa, a tensile strength of between 1000 and 1800 MPa and an elongation of between 1% and 10%. Furthermore, the method of making hot rolled light-gauge martensitic steel sheet may comprise hot rolling the steel sheet to between 15% and 35% reduction and rapidly cooling to form a steel sheet with a microstructure having at least 75% by volume martensite plus bainite, a yield strength of between 700 and 1300 MPa, a tensile strength of between 1000 and 1800 MPa and an elongation of between 1% and 10%.

BRIEF DESCRIPTION OF THE DRAWINGS

The invention may be more fully illustrated and explained with reference to the accompanying drawings in which.

DETAILED DESCRIPTION OF THE DRAWINGS

Figure 1:
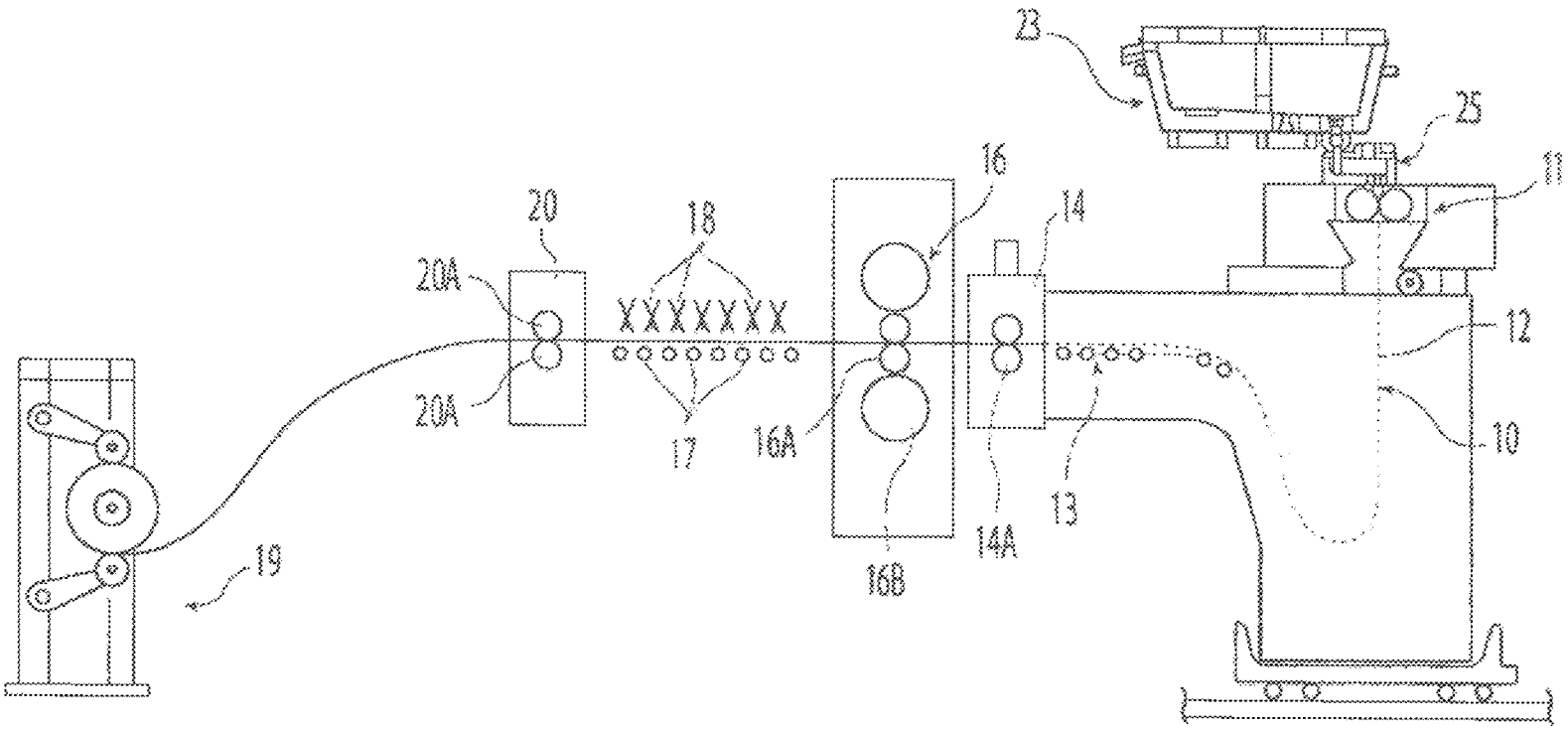
FIG. 1 illustrates a strip casting installation incorporating an in-line hot rolling mill and coiler.
Figure 2:
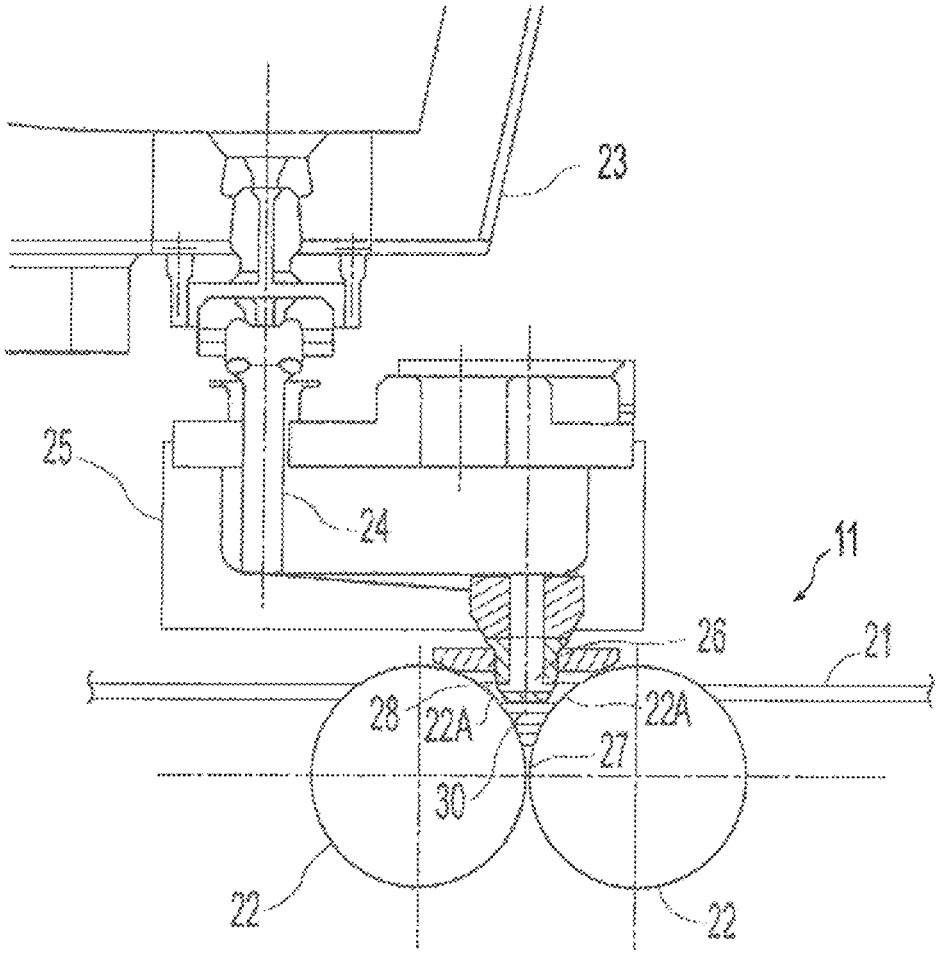
FIG. 2 illustrates details of the twin roll strip caster.

FIGS. 1 and 2 illustrate successive parts of strip caster for continuously casting steel strip of the present invention. A twin roll caster 11 may continuously produce a cast steel strip 12, which passes in a transit path 10 across a guide table 13 to a pinch roll stand 14 having pinch rolls 14A. Immediately after exiting the pinch roll stand 14, the strip passes into a hot rolling mill 16 having a pair of work rolls 16A and backing rolls 16B, where the cast strip is hot rolled to reduce a desired thickness. The hot rolled strip passes onto a run-out table 17 where the strip enters an intensive cooling section via water jets 18 (or other suitable means). The rolled and cooled strip then passes through a pinch roll stand 20 comprising a pair of pinch rolls 20A and then to a coiler 19.

As shown in FIG. 2, twin roll caster 11 comprises a main machine frame 21, which supports a pair of laterally positioned casting rolls 22 having casting surfaces 22A. Molten metal is supplied during a casting operation from a ladle (not shown) to a tundish 23, through a refractory shroud 24 to a distributor or moveable tundish 25, and then from the distributor or moveable tundish 25 through a metal delivery nozzle 26 between the casting rolls 22 above the nip 27. The molten metal delivered between the casting rolls 22 forms a casting pool 30 above the nip supported on the casting rolls. The casting pool 30 is restrained at the ends of the casting rolls by a pair of side closure dams or plates 28, which may be urged against the ends of the casting rolls by a pair of thrusters (not shown) including hydraulic cylinder units (not shown) connected to the side plate holders. The upper surface of casting pool 30 (generally referred to as the "meniscus" level) usually is above the lower end of the delivery nozzle so that the lower end of the delivery nozzle is immersed within the casting pool 30. Casting rolls 22 are internally water cooled so that shells solidify on the moving casting roll surfaces as they pass through the casting pool, and are brought together at the nip 27 between them to produce the cast strip 12, which is delivered downwardly from the nip between the casting rolls.

The twin roll caster may be of the kind that is illustrated and described in some detail in U.S. Pat. Nos. 5,184,668 and 5,277,243 or U.S. Pat. No. 5,488,988, or U.S. patent application Ser. No. 12/050,987. Reference is made to those patents which are incorporated by reference for appropriate construction details of a twin roll caster that may be used in an embodiment of the present invention.

The in-line hot rolling mill 16 provides 15% to 50% reductions of strip from the caster. On the run-out-table 17, the cooling may include a water cooling section to control the cooling rates of the austenite transformation to achieve desired microstructure and material properties.

Figure 3:
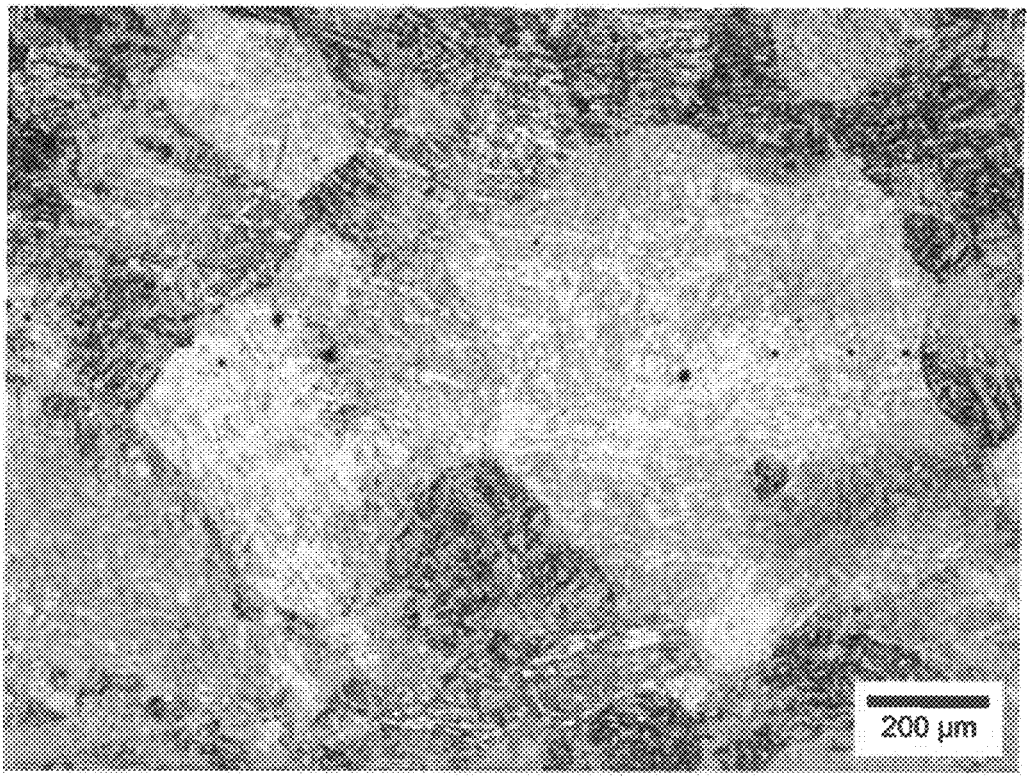
FIG. 3 is a micrograph of a steel sheet with a microstructure having at least 75% martensite.

A light-gauge martensitic steel sheet may be made from a molten melt produced in a twin roll caster. The hot rolled light-gauge martensitic steel sheet may be made by the steps comprising: (a) preparing a molten steel melt comprising: (i) by weight, between 0.20% and 0.35% carbon, less than 1.0% chromium, between 0.7% and 2.0% manganese, between 0.10% and 0.50% silicon, between 0.1% and 1.0% copper, less than 0.05% niobium, less than 0.5% molybdenum, and silicon killed containing less than 0.01% aluminum, and (ii) the remainder iron and impurities resulting from melting; (b) solidifying at a heat flux greater than 10.0 $MW/m^2$ producing a steel sheet less than 2.0 mm in thickness and cooling in a non-oxidizing atmosphere to below 1080° C. and above $Ar_3$ temperature at a cooling rate greater than 15° C./s; and (c) hot rolling the steel sheet to between 15% and 50% reduction and rapidly cooling to form a steel sheet with a microstructure having at least 75% martensite, a yield strength of between 700 and 1300 MPa, a tensile strength of between 1000 and 1800 MPa and an elongation of between 1% and 10%. FIG. 3 shows a micrograph of a steel sheet with a microstructure having at least 75% martensite from a prior austenite grain size of at least 100 μm.

For example, a martensitic steel sheet was made of the present invention comprising by weight 0.21% carbon, 1.01% manganese, 0.12% silicon, 0.19% molybdenum, 0.48% chromium, and 0.017% niobium and having a yield strength of 1000 MP, tensile strength of 1385 MPa and an elongation of 5% following quenching.

The present steel sheet composition could not be made with carbon levels below 0.20% because it is inoperative with peritectic cracking of the steel sheet. Table No. 1 shows the effect of carbon content on sheet cracking. At a carbon content below 0.20% the peritectic reaction proceeds too quickly and it is not possible to prevent cracking.

TABLE 1

Relation between carbon and coil quality with cracking

| Trial | Quality | C | Mn | Si | S | N | Heat Removal | Normalized Heat Flux |
|---|---|---|---|---|---|---|---|---|
| 8160-1 | Cracks | 0.182 | 0.78 | 0.26 | 0.002 | 0.004 | 3.125 | 12.0 |
| 8165-1 | No Cracks | 0.244 | 0.80 | 0.25 | 0.003 | 0.008 | 3.02 | 11.6 |
| 8165-2 | Cracks | 0.195 | 0.81 | 0.21 | 0.003 | 0.007 | 3.515 | 13.5 |
| 8194 | No Cracks | 0.209 | 1.01 | 0.12 | 0.003 | 0.006 | 2.784 | 10.7 |
| 8203 | No Cracks | 0.252 | 1.04 | 0.13 | 0.002 | 0.005 | 3.041 | 11.7 |
| 8215 | No Cracks | 0.204 | 1.02 | 0.15 | 0.002 | 0.006 | 2.647 | 10.2 |

Additionally, the hot rolled light-gauge martensitic steel sheet may be made by the further tempering the steel sheet at a temperature between 150° C. and 250° C. for between 2 and 6 hours. Tempering the steel sheet provides improved elongation with minimal loss in strength. For example, a steel sheet having a yield strength of 1250 MPa, tensile strength of 1600 MPa and an elongation of 2% was improved to a yield strength of 1250 MPa, tensile strength of 1525 MPa and an elongation of 5% following tempering as described herein.

The martensitic steel sheet may further comprise by weight greater than 0.005% niobium or greater than 0.01% or 0.02% niobium. The martensitic steel sheet may comprise by weight greater than 0.05% molybdenum or greater than 0.1% or 0.2% molybdenum. The martensitic steel sheet may be silicon killed containing by weight less than 0.008% aluminum or less than 0.006% aluminum. The molten melt may have a free oxygen content between 5 to 70 ppm. The steel sheet may have a total oxygen content greater than 50 ppm. The inclusions include $MnOSiO_2$ typically with 50% less than 5 μm in size and have the potential to enhance microstructure evolution and, thus, the strip mechanical properties.

The molten melt may be solidified at a heat flux greater than 10.0 $MW/m^2$ into a steel sheet less than 2.0 mm in thickness, and cooled in a non-oxidizing atmosphere to below 1080° C. and above $Ar_3$ temperature at a cooling rate greater than 15° C./s. A non-oxidizing atmosphere is an atmosphere typically of an inert gas such as nitrogen or argon, or a mixture thereof, which contains less than about 5% oxygen by weight.

In some embodiments, the martensite in the steel sheet may come from an austenite grain size of greater than 100 μm. In other embodiments, the martensite in the steel sheet may come from an austenite grain size of greater than 150 μm. Rapid solidification at heat fluxes greater than 10 $MW/m^2$ enables the production of an austenite grain size that is responsive to controlled cooling after subsequent hot rolling to enable the production of crack free sheet.

The steel sheet may be hot rolled to between 15% and 50% reduction and rapidly cooled to form a steel sheet with a microstructure having at least 75% martensite plus bainite, a yield strength of between 700 and 1300 MPa, a tensile strength of between 1000 and 1800 MPa and an elongation of between 1% and 10%. Further, the steel sheet may be hot rolled to between 15% and 35% reduction and rapidly cooled to form a steel sheet with a microstructure having at least 75% martensite plus bainite, a yield strength of between 700 and 1300 MPa, a tensile strength of between 1000 and 1800 MPa and an elongation of between 1% and 10%.

While the invention has been illustrated and described in detail in the foregoing drawings and description, the same is to be considered as illustrative and not restrictive in character, it being understood that only illustrative embodiments thereof have been shown and described, and that all changes and modifications that come within the spirit of the invention described by the following claims are desired to be protected. Additional features of the invention will become apparent to those skilled in the art upon consideration of the description. Modifications may be made without departing from the spirit and scope of the invention.

What is claimed is:

1. A hot rolled light-gauge martensitic steel sheet made by the steps comprising:

(a) preparing a molten steel melt producing through a twin roll caster an as-cast carbon alloy steel sheet less or equal to 2 mm in thickness comprising:

(i) by weight, between 0.20% and 0.35% carbon, less than 1.0% chromium, between 0.7% and 2.0% manganese, between 0.10% and 0.50% silicon, between 0.1% and 1.0% copper, less than 0.05% niobium, less than 0.5% molybdenum, and silicon killed containing less than 0.01% aluminum, and (ii) the remainder iron and impurities resulting from melting;

(b) solidifying the molten melt at a heat flux greater than 10 $MW/m^2$ into a steel sheet less than 2.0 mm in thickness and cooling the steel sheet in a non-oxidizing atmosphere to below 1080° C. and above the $Ar_3$ temperature at a cooling rate greater than 15° C./s; and (c) hot rolling the steel sheet to between 15% and 50% reduction and rapidly cooling to form a steel sheet with a microstructure having at least 75% by volume martensite or martensite plus bainite, a yield strength of between 700 and 1300 MPa, a tensile strength of between 1000 and 1800 MPa and an elongation of between 1% and 10%.

2. The hot rolled light-gauge martensitic steel sheet made by the steps as claimed in claim 1 further comprising the step of:

(d) tempering the steel sheet at a temperature between 150° C. and 250° C. for between 2 and 6 hours.

3. The hot rolled light-gauge martensitic steel sheet as claimed in claim 1 wherein the martensite in the steel sheet comes from an austenite grain size of greater than 100 μm.

4. The hot rolled light-gauge martensitic steel sheet as claimed in claim 1 wherein the martensite in the steel sheet comes from an austenite grain size of greater than 150 μm.

5. The hot rolled light-gauge martensitic steel sheet as claimed in claim 1 comprising hot rolling the steel sheet to between 15% and 35% reduction and rapidly cooling to form a steel sheet with a microstructure having at least 75% by volume martensite, a yield strength of between 700 and 1300 MPa, a tensile strength of between 1000 and 1800 MPa and an elongation of between 1% and 10%.

6. The hot rolled light-gauge martensitic steel sheet as claimed in claim 1 comprising hot rolling the steel sheet to between 15% and 35% reduction and rapidly cooling to form a steel sheet with a microstructure having by volume at least 75% martensite plus bainite, a yield strength of between 700 and 1300 MPa, a tensile strength of between 1000 and 1800 MPa and an elongation of between 1% and 10%.

7. The hot rolled light-gauge martensitic steel sheet as claimed in claim 1 comprising inclusions including $MnO\text{-}SiO_2$ with 50% less than 5 μm in size.

8. The hot rolled light-gauge martensitic steel sheet as claimed in claim 1 where the cooled steel sheet has a total oxygen content greater than 50 ppm.

9. The hot rolled light-gauge martensitic steel sheet as claimed in claim 1 where the molten melt has a free oxygen content between 5 and 70 ppm.

10. The hot rolled light-gauge martensitic steel sheet as claimed in claim 1 further comprising hot rolling the steel sheet to between 15% and 50% reduction and rapidly cooling at a rate of more than 100° C./s to between 100 and 20° C. to form a steel sheet with a microstructure having at least 75% by volume martensite, a yield strength of between 700 and 1300 MPa, a tensile strength of between 1000 and 1800 MPa and an elongation of between 1% and 10%.

11. A method of making hot rolled light-gauge martensitic steel sheet comprising the steps of:

(a) preparing a molten steel melt comprising:

(i) by weight, between 0.20% and 0.35% carbon, less than 1.0% chromium, between 0.7% and 2.0% manganese, between 0.10% and 0.50% silicon, between 0.1% and 1.0% copper, less than 0.05% niobium, less than 0.5% molybdenum, silicon killed with less than 0.01% aluminum, and (ii) the remainder iron and impurities resulting from melting;

(b) forming the melt into a casting pool supported on casting surfaces of a pair of cooled casting rolls having a nip there between;

(c) counter rotating the casting rolls and solidifying at a heat flux greater than 10.0 $MW/m^2$ the molten melt into a steel sheet to less than 2.0 mm in thickness delivered downwardly from the nip and cooling the sheet in a non-oxidizing atmosphere to below 1080° C. and above the $Ar_3$ temperature at a cooling rate greater than 15° C./s and;

(d) hot rolling the steel sheet to between 15% and 50% reduction and rapidly cooling to form a steel sheet with a microstructure having at least 75% by volume martensite or martensite plus bainite, a yield strength of between 700 and 1300 MPa, a tensile strength of between 1000 and 1800 MPa and an elongation of between 1% and 10%.

12. The method of making hot rolled light-gauge martensitic steel sheet as claimed in claim 11 further comprising the step of:

(e) tempering the steel sheet at a temperature between 150° C. and 250° C. for between 2 and 6 hours.

13. The method of making hot rolled light-gauge martensitic steel sheet as claimed in claim 11 further comprising hot rolling the steel sheet to between 15% and 35% reduction and rapidly cooling to form a steel sheet with a microstructure having at least 75% by volume martensite, a yield strength of between 700 and 1300 MPa, a tensile strength of between 1000 and 1800 MPa and an elongation of between 1% and 10%.

14. The method of making hot rolled light-gauge martensitic steel sheet as claimed in claim 11 comprising hot rolling the steel sheet to between 15% and 35% reduction and rapidly cooling to form a steel sheet with a microstructure having by volume at least 75% martensite plus bainite, a yield strength of between 700 and 1300 MPa, a tensile strength of between 1000 and 1800 MPa and an elongation of between 1% and 10%.

15. The method of making hot rolled light-gauge martensitic steel sheet as claimed in claim 11 where the cooled steel sheet has a total oxygen content greater than 50 ppm.

16. The method of making hot rolled light-gauge martensitic steel sheet as claimed in claim 11 where the molten melt has a free oxygen content between 5 and 70 ppm.

17. The method of making hot rolled light-gauge martensitic steel sheet as claimed in claim 11 comprising hot rolling the steel sheet to between 15% and 50% reduction and rapidly cooling to between 100 and 20° C. at a rate of more than 100° C./s to form a steel sheet with a microstructure having at least 75% by volume martensite, a yield strength of between 700 and 1300 MPa, a tensile strength of between 1000 and 1800 MPa and an elongation of between 1% and 10%.

18. The method of making hot rolled light-gauge martensitic steel sheet hot rolled as claimed in claim 11 wherein the martensite comes from an austenite grain size of greater than 100 μm.

19. The method of making hot rolled light-gauge martensitic steel sheet hot rolled as claimed in claim 11 wherein the martensite comes from an austenite grain size of greater than 150 μm.

* * * * *